United States Patent [19]

Beale

[11] 4,330,993

[45] May 25, 1982

[54] HYDRODYNAMIC LUBRICATION SYSTEM FOR PISTON DEVICES PARTICULARLY STIRLING ENGINES

[75] Inventor: William T. Beale, Athens, Ohio

[73] Assignee: Sunpower, Inc., Athens, Ohio

[21] Appl. No.: 97,409

[22] Filed: Nov. 26, 1979

[51] Int. Cl.[3] ..... F02G 1/04

[52] U.S. Cl. ..... 60/520; 92/173

[58] Field of Search ..... 92/153, 173, 86.5, DIG. 2; 60/517, 520

[56] References Cited

U.S. PATENT DOCUMENTS 2,995,122 8/1961 Randall ..... 92/173 X 3,828,558 8/1974 Beale ..... 60/520

*Primary Examiner*—Allen M. Ostrager

*Attorney, Agent, or Firm*—Frank H. Foster

[57] ABSTRACT

This invention relates to a free piston Stirling engine in which a structure for aiding in the lubrication of the engine is provided. The piston of the Stirling engine is provided with turbine surfaces, such as blades. Working fluid entering the cylinder chamber applies a spin torque to the piston thereby causing the piston to spin and entrain gas about its perimeter for hydrodynamic gas lubrication.

6 Claims, 7 Drawing Figures

HYDRODYNAMIC LUBRICATION SYSTEM FOR PISTON DEVICES PARTICULARLY STIRLING ENGINES

TECHNICAL FIELD

This invention relates to apparatus and a method for the lubrication of expansible chamber devices of the type having a cylinder with a piston reciprocating therein and a fluid flowing in and out of the chamber. The apparatus and method of the present invention is particularly useful for lubricating the displacer piston, the power piston or both in a free piston Stirling engine.

BACKGROUND OF THE INVENTION

One major advantage of the free piston Stirling engine is that the working gas can be entirely sealed within the engine to prevent its contamination or loss by leakage. It is undesirble to lubricate the pistons of the free piston Stirling engine with traditional lubricants, such as petroleum based oil and grease, because such lubricants vaporize into the working gas and reduce its efficiency.

Nonetheless, it is still desirable to lubricate such engines for the purpose of extending the life of the engine and reducing its wear and maintenance.

It is therefore an object of the present invention to effect the hydrodynamic lubrication of pistons through use of the fluids which act upon or are acted upon by the pistons in the operation of the device, and particularly to lubricate the pistons of Stirling engines with the working gas of the engine.

BRIEF DISCLOSURE OF THE INVENTION

In the present invention a torque force is applied to the piston to cause it to spin at a sufficient angular velocity that it will entrain and drag along its outer surface some of the fluid which acts upon or is acted upon by the piston. This layer of fluid separates the interfacing and relatively sliding surfaces of the piston and its associated cylinder.

In particular, the torque is applied by creating a turbine effect during the intake or exhaust of the fluid. The torque is applied to the piston by impinging a flowing stream of the fluid on the piston as the fluid enters or leaves the expansible chamber in a manner which creates a turbine effect urging the piston to spin.

Desirably, inlet or outlet ports are formed through the cylinder about the piston or pistons. Turbine surfaces, such as blades or the walls of slots are formed in and spaced around the pistons. The ports are positioned so that during the normal operation of the device, the fluid will flow through the port and periodically impinge upon the turbine surfaces to apply a circumferential force component on the piston. By selected positioning of the ports in many devices, such as the free piston Stirling engine, the normal operation of the device may be maintained undisturbed while gaining the advantages of hydrodynamic lubrication in accordance with the present invention.

DETAILED DESCRIPTION

Figure 1:
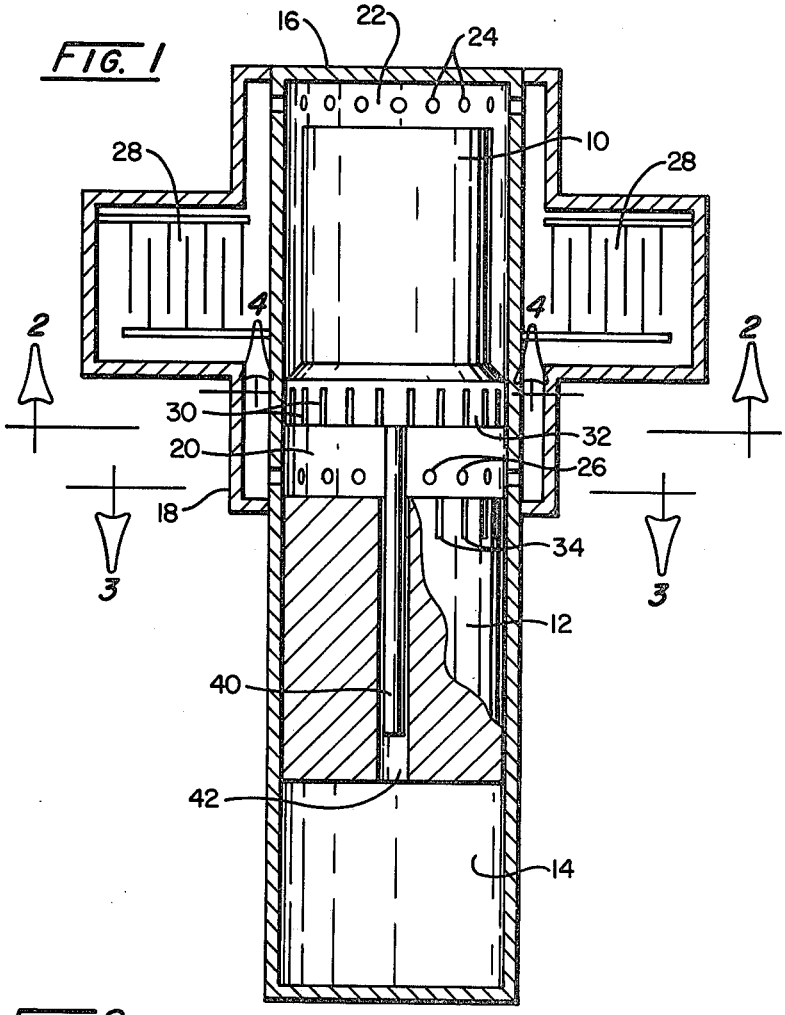
FIG. 1 is a diagrammatic view in axial cross section illustrating a free piston Stirling engine which embodies the invention.
Figure 2:
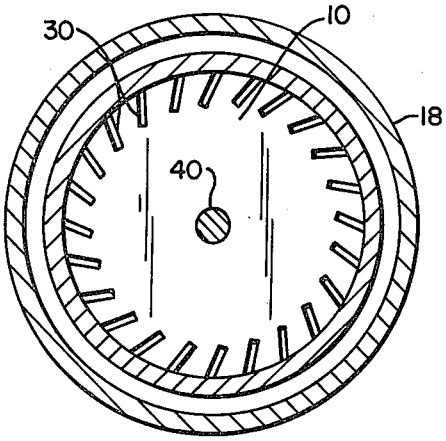
FIG. 2 is a bottom view of the displacer piston illustrated in the embodiment of FIG. 1.
Figure 3:
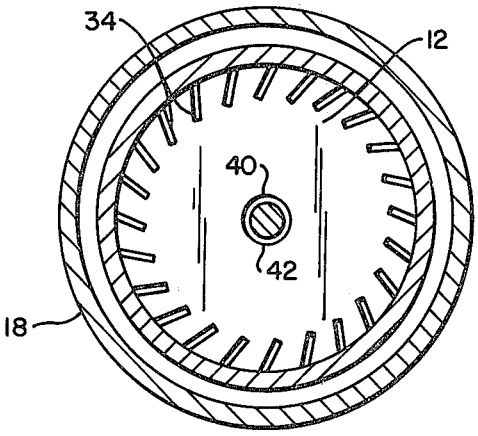
FIG. 3 is a top view of the power piston illustrated in the embodiment of FIG. 1.

FIG. 1 illustrates a free piston Stirling engine having a displacer piston 10 and a power piston 12 which reciprocate in a single, cooperating cylinder 14.

In the illustrated engine, heat is applied at its end 16 and withdrawn from its intermediate area 18. Therefore, the engine has its compression space 20 adjacent its cooled area 18 and its expansion space 22 adjacent its heated end 16, these spaces being formed at opposite ends of the displacer 10. The engine is provided with expansion space ports 24 which are in fluid communication with the expansion space 22 and compression space ports 26 which are in fluid communication with the compression space 20. These ports 24 and 26 are in communication with each other through a conventional regenerator 28.

The engine operates in the conventional manner as well known in the art. A working gas is contained within the expansion and compression spaces and is alternately forced into the heated expansion space 22 and the cooled compression space 20 by the displacer. The alternate heating and cooling of the working gas causes the gas to alternately expand and increase its pressure and contract and decrease its pressure. These alternate changes in pressure cause the power piston to reciprocate and also result in proper phasing of the reciprocating displacer piston. Since the fundamental operation of the free piston Stirling engine is well described in the prior art no further description is necessary here.

A plurality of inwardly extending slots 30 are arranged around the seal skirt portion 32 of the displacer piston. Similarly, a plurality of such slots 34 are arranged around the power piston 12. The inner walls of these slots form turbine surfaces against which working gas can be impinged as it flows between the compression and expansion spaces to create a turbine effect and a resulting torque on these pistons.

In the embodiment illustrated in FIG. 1 the compression space ports 26 are positioned to register with the slots 30 of the displacer piston 10 during the end of the stroke of the displacer piston 10 which is nearest or proximal to the compression space 20 and also to register with the slots 34 of the power piston at the end of its stroke which is nearest or proximal to the compression space 20.

The compression space ports 26 are positioned to direct the flowing stream of working gas upon the turbine surfaces in the slots of the pistons to impart an average torque in one direction upon the piston. As described below, the cyclical reciprocation of both pistons is such that their slots register with the ports 26 during a part of the cycle that the gas is flowing in a single direction. For example, in the embodiment illustrated, the gas impinges upon the slots 30 of the displacer piston 10 at a time in the cycle when gas is entering the compression space 20 and impinges upon the slots 34 of the power piston 12 at a time when the working gas is leaving the compression space 20 and flowing into the expansion space 22. During the registration of the slot walls of either piston with the ports, the flowing gas applies an impulse torque to the piston.

Figure 6:
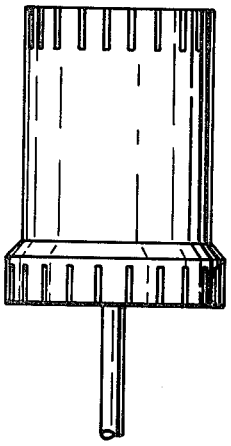
FIG. 6 is a side view of an alternative displacer piston structure embodying the present invention.
Figure 4:
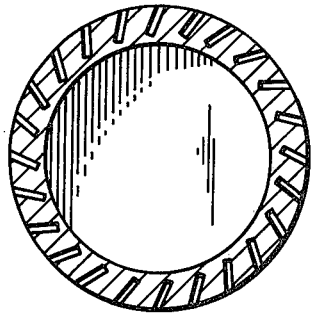
FIG. 4 is a view in cross section of an alternative embodiment of the ports in the cylinder wall illustrating an oblique port orientation.

Alternatively, the displacer turbine slots may be formed at the opposite end of the displacer piston to be impinged upon by working fluid flowing into the expansion space 22. As a still further alternative, the slots may be provided at both ends of the displacer piston 10 as illustrated in FIG. 6.

The structural configuration and orientation of the ports as well as of the turbine surfaces may be modified in a great variety of ways as is well known in the turbine art. For example, the slots may be curved and/or the inlet ports may be obliquely inclined to the cylindrical wall surface in order to impart a tangential component to the fluid flow. The various alternative turbine systems are not discussed in more detail because they are well discussed in the prior turbine art.

Furthermore, the turbine surfaces may be formed on a separate structure which is attached to the piston or the piston rod. However, for purposes of this patent, because such systems are functionally equivalent to being a part of the piston, they are considered to be a part of the piston.

As a further alternative, the ports may be positioned at the end wall or walls of the chamber of a reciprocating piston, expansible chamber device and provided with suitable cooperating turbine surfaces on the piston so that the fluid flow will apply the appropriate torque force to the piston during intake or exhaust of the fluid.

As still a further alternative the ports at the walls of the cylinder may be interposed between the extremes of the piston stroke. It is not necessary that they be positioned so that all flow be in a single direction during the interval that the turbine surfaces are in registration with the fluid ports. It is only necessary that during the interval of registration there be a net or average flow in one direction or the other.

As still another alternative, the ports or the turbine surfaces may additionally have some axial spacing rather than being arranged circularly at spaced intervals. For example, the ports may be somewhat helically arranged about the cylinder to provide a broader torque impulse of longer duration.

In the embodiment of FIG. 1 it is desirable to cause the displacer piston 10 and the power piston 12 to spin in opposite direction to assure that their interfacing portions, namely the piston rod 40 and its reciprocally associated bore 42, will be rotating relative to each other. This will assure that these interfacing surfaces are also lubricated. Of course, the two could be spun in the same direction at different speeds but with less effectiveness.

To accomplish this in the embodiment illustrated in FIG. 1, the slots 30 and the slots 34 may be formed in the same direction in the operable position which will provide opposite spin torques because the working gas flows into the compression space 20 when it impinges upon the turbine surfaces 32 of the displacer piston 10 and flows out of the compression space 20 when it impinges upon the turbine surfaces 34 of the power piston 12.

The advantages of the system of the present invention wherein a fluid, which acts upon, or is acted upon a piston, is directed to cause a turbine effect which in turn imparts a spin to lubricate the piston hydrodynamically are not limited to the coaxial free piston Stirling engines.

For example, it is applicable to free piston Stirling engines in which the displacer piston and the power piston reciprocate in different cylinders. Further, it is applicable to the broader range of expansible chamber devices which have a piston which both reciprocates and is free to rotate about its axis. For example, many such piston devices have a piston which is connected by an intermediate piston or connecting rod to a crankshaft. The addition of a suitable bearing on the piston rod in such a device will enable its piston to be free for rotation in addition to reciprocation. Thus, the principles of the present invention are applicable to other engines, pumps and motors of the expansible chamber, reciprocating piston type.

Figure 5:
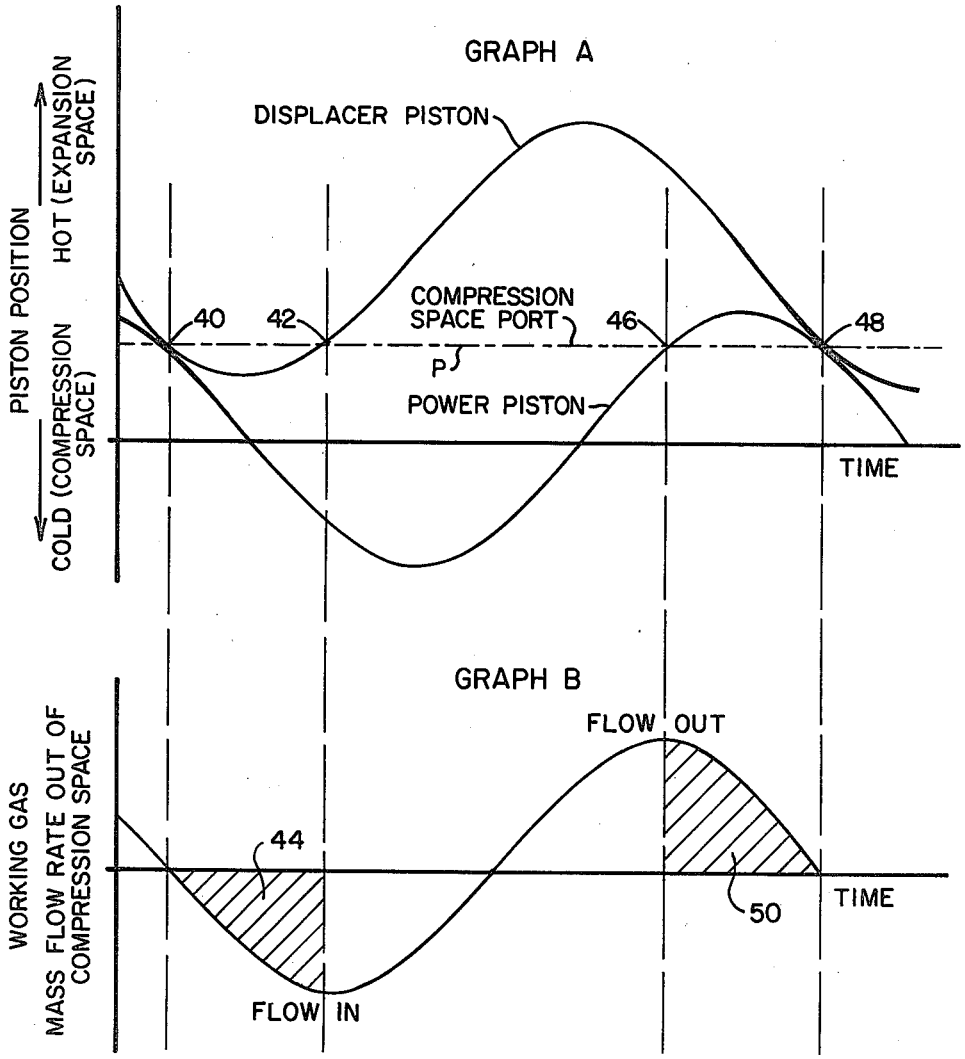
FIG. 5 is a graph illustrating the operation of the preferred embodiment of the invention.

FIG. 5 illustrates the operation of the embodiment of the invention illustrated in FIG. 1. Graph A of FIG. 5 is a plot representing the position of the opposing faces of the displacer piston and the power piston within the cylinder 14 as a function of time. The horizontal line P represents the position in the cylinder of the compression space ports 26. Of course, in a more detailed graph the horizontal line P actually would consist of a pair of parallel horizontal lines separated by a distance representing the width of the ports. In Graph A the more positive direction on the vertical axis represents positions nearer the hot or expansion space 22.

Whenever the displacer piston face is more negative than the horizontal line P or whenever the power piston face is more positive than the horizontal line P, the slots in the respective pistons are in registration with the compression space ports 26.

Graph B is a plot of the flow rate of the working gas with respect to time.

At point 40 in Graph A the displacer piston slots begin registration with the compression space ports 26. This registration continues until point 42. Therefore, during the time interval from points 40 to 42 a torque impulse is applied to the displacer piston by the gas which is flowing into the compression space and illustrated in the shaded area 44.

Similarly, during the time interval from point 46 to point 48 the power piston receives a torque impulse from the working gas flow illustrated in the shaded area 50.

Figure 7:
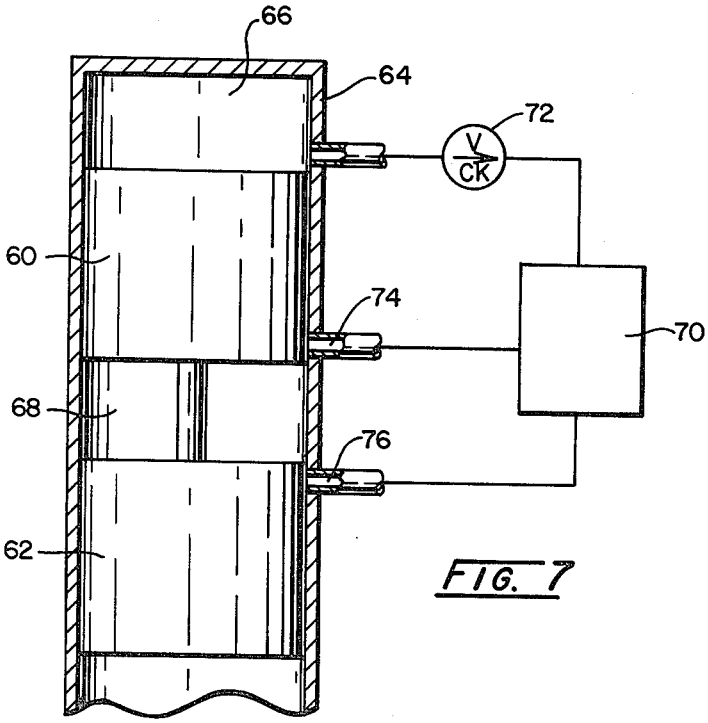
FIG. 7 is a diagrammatic illustration of an alternative embodiment of the invention.

FIG. 7 diagrammatically illustrates an alternative embodiment of the invention for use in a free piston Stirling engine in which the flowing stream of working fluid which impinges upon the turbine surfaces to impart the torque is obtained from a structure which is different from the conventional gas flow path between the hot space and the cold space. The diagram only illustrates the structures relevant to this modification and does not repeat many of the structures which are illustrated in FIG. 1.

The embodiment of FIG. 7 has a hot space 66, a cold space 68, a power piston 62 and a displacer piston 60 mounted within the cylinder 64 in the same manner as the device of FIG. 1.

However, the structure illustrated in FIG. 7 additionally is provided with a storage chamber 70 which is in communication with a port 73 or several such ports through a check valve 72. The storage chamber is also in communication with ports 74 and 76. A plurality of annularly arranged ports may be substituted for ports 74 and 76.

Whenever the port 73 is exposed by the displacer 60 and the working gas pressure in the work space is greater than the gas pressure in the storage chamber 70, working gas will flow into the storage chamber. Thus, gas flows during the high pressure part of the operating cycle into the storage chamber 70 through the check valve 72.

The ports 74 and 76 are positioned so that they will be in registration with the turbine surfaces during a relatively low pressure portion of the operating cycle. Thus, when such registration occurs, gas can flow from the storage chamber and impinge upon the turbine surfaces to impart a torque upon the pistons in a manner similar to that described above. In this manner the storage chamber 70 accumulates working fluid during the high pressure portion of the operating cycle and releases it to flow against the turbine surfaces during the lower pressure portions of the cycle.

I claim:

1. In a free piston Stirling engine of the type having a displacer piston and a power piston which reciprocate in cooperating cylinders, a lubrication aiding structure comprising:

(a) a plurality of turbine surfaces formed on and arranged around at least a first one of said pistons; and (b) at least one of the working gas ports in the wall of at least one of said cylinders positioned and formed to direct a flowing stream of the working gas upon said surfaces to apply an average torque upon said piston;

wherein a turbine effect results which applies an average spin torque upon said first piston for causing said first piston to spin and entrain gas about its perimeter for hydrodynamic gas lubrication.

2. A lubrication structure in accordance with claim 1 wherein said port is positioned longitudinally along said wall to provide a turbine effect at the position which said turbine surfaces occupy during a unidirectional flow of working gas through said port.

3. A lubrication structure in accordance with claim 1 wherein said turbine surfaces are formed around both of said pistons, the turbine surfaces of each of said pistons similarly cooperating with a working gas port in its associated cylinder wall for spinning both of said pistons.

4. A lubrication structure in accordance with claim 3 wherein said engine is of the type having a cylinder in which both said displacer piston and said power piston reciprocate, wherein said turbine surfaces are formed about the proximal ends of said pistons and are similarly oriented and wherein said port is the working gas port intermediate said pistons near the proximal ends of the stroke of said pistons for applying opposite torques to said pistons.

5. A structure in accordance with claim 2 wherein said turbine surfaces are formed at both ends of said displacer piston and wherein both the compression space ports and the expansion space ports direct flowing working gas on said turbine surfaces at the respective ends of said displacer piston to apply torque forces to said displacer piston in the same direction.

6. A lubrication structure in accordance with claim 1 wherein said turbine surfaces comprise the walls of slots formed into the walls of said piston obliquely to the adjacent peripheral surface of said piston.

* * * * *